US006472114B2

(12) United States Patent
Morita et al.

(10) Patent No.: US 6,472,114 B2
(45) Date of Patent: Oct. 29, 2002

(54) COATING FLUID FOR ELECTRIC CHARGE GENERATING LAYER, ORGANIC ELECTROPHOTOGRAPHIC RECEPTOR, AND METHOD TO MANUFACTURING THE SAME

(75) Inventors: Tatsuhiro Morita, Kashiba (JP); Tomomi Nakamura, Minamikawachi (JP); Rikiya Matsuo, Nara (JP); Akihiko Kawahara, Nara (JP); Koichi Toriyama, Yao (JP); Mikio Kakui, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/944,386

(22) Filed: Sep. 4, 2001

(65) Prior Publication Data

US 2002/0051921 A1 May 2, 2002

(30) Foreign Application Priority Data

Sep. 4, 2000 (JP) ..... 2000-267327

(51) Int. Cl.[7] ..... G03G 5/05
(52) U.S. Cl. ..... 430/78; 430/133
(58) Field of Search ..... 430/78, 133, 56

(56) References Cited

U.S. PATENT DOCUMENTS 5,153,088 A * 10/1992 Muto et al. ..... 430/78
5,942,360 A * 8/1999 Janezic et al. ..... 430/58

FOREIGN PATENT DOCUMENTS

| | | |
|---|---|---|
| JP | H02-203348 | 8/1990 |
| JP | H04-014053 | 1/1992 |
| JP | H06-208230 | 7/1994 |
| JP | H-07-295247 | 11/1995 |
| JP | 2853336 | 11/1998 |

* cited by examiner

*Primary Examiner*—John Goodrow
(74) *Attorney, Agent, or Firm*—Nixon & Vanderhye P.C.

(57) ABSTRACT

An organic electrophotographic receptor comprising at least an undercoating layer, an electric charge generating layer, and an electric charge transferring layer which are laminated in said order, wherein a coating fluid 5 for forming said electric charge generating layer comprising an electric charge generating material, a binding resin, a silicon oil having a surface tension of 22 mN/m or less, and an organic solvent is stored inside a tank 4, and a photosensitive base 1 supported by a chucking device 8 is dipped into said coating tank 4 so as to form said electric charge generating layer.

14 Claims, 2 Drawing Sheets

COATING FLUID FOR ELECTRIC CHARGE GENERATING LAYER, ORGANIC ELECTROPHOTOGRAPHIC RECEPTOR, AND METHOD TO MANUFACTURING THE SAME

FIELD OF THE INVENTION

The present invention relates to a laminate type organic electrophotographic receptor used in an image forming device such as a copying machine, a printer or a facsimile, and especially relates to an improved coating fluid for forming an improved electric charge generating layer and the organic electrophotographic receptor formed using the coating fluid, and the method of manufacturing the same.

Heretofore, along with the improvement in developing the material for an electrophotographic receptor, the material for the receptor has changed from inorganic materials such as zinc oxide, cadmium sulfide, selenium amorphous and amorphous silicon, to organic photoconductive materials (OPC). The electrophotographic receptor formed using the organic photoconductive material has some problems related to its sensitivity, durability and environmental stability, but it has greater advantages compared to the inorganic material in its toxicity, cost, and freedom of material design and the like.

Therefore, many proposals for improving the sensitization of the organic electrophotographic receptor exist.

There are two types of photoconductive layer of the organic electrophotographic receptor, a single layered type and a laminated type. Since the laminate type receptor (hereinafter called "separated-function receptor") composed mainly of a layer (hereinafter called "charge generating layer:CGL") including a material that generates a charge carrier when exposed to light (hereinafter called "charge generating material:CGM") and a layer (hereinafter called "charge transferring layer:CTL") mainly formed of a material that receives the charge carrier generated at the CGL and transfers the same (hereinafter called "charge transferring material:CTM") is known to provide advantageous sensitization, it constitutes the main portion of organic receptors that are currently utilized. Further, since recent studies have improved the durability of the above-mentioned laminated receptor, it is considered to become the mainline of receptors in the near future.

Moreover, the durability of the receptor is further improved by providing an undercoating layer (hereinafter called "UCL") on the conductive base so as to improve the electrification, to prevent unnecessary charge injection from the conductive base, to cover the defects on the surface of the conductive base, to prevent the creation of pinholes, and to improve the adhesiveness of the photosensitive layer.

These photosensitive layers are formed by creating a coating fluid including photosensitive material by dissolving or dispersing the organic photoconductive material for each layer together with a binding resin in an organic solvent, and applying and drying the coating fluids including the photosensitive material on the conductive base in order.

The method for applying the organic electrophotographic photosensitive layer includes a spraying method, a bar-coat method, a roll coat method, a blade method, a ring method, and a dip coating method. The dip coating method is a method where the (cylindrical) conductive base is immersed into a coating tank (filled with the photosensitive material) and then pulled out either at constant speed or at varying speeds set freely so as to form the photosensitive layer. This dip coating method is relatively easy and advantageous in its productivity and its low cost, so it is often used when manufacturing the electrophotographic receptor.

One example of the device used for dip coating is shown in FIG. 1.

A coating fluid 5 including the photosensitive material is stored in a coating tank 4. A cylindrical conductive base 1, the upper end of which is supported in an airtight manner by a chucking device 8, is immersed into the coating solution 5 of the coating tank 4. Upon dipping, the chucking device 8 is lowered by an elevating machine 2 equipped with a motor 3, and the base 1 is immersed into the coating fluid 5. After enough dipping has been performed, the chucking device 8 is raised by the elevator 2. The elevator 2 enables the base 1 to be immersed into the coating tank for a desired depth by controlling and confirming the rotation of the motor 3. According to another example, the coating tank can be elevated when performing the coating.

Upon dipping, the fluid that has overflown from the tank 4 is collected into an auxiliary tank as shown in arrow 13, and the coating fluid is adjusted so as to maintain a constant viscosity using a viscometer 16 and a fluid adding device 10. After stirring the fluid with a stirring device (impeller) 12, foreign matter in the fluid is removed through a filter 9, and as shown in arrow 14, the fluid is returned to the coating tank by a pump 6, and the tank 4 is filled with the coating fluid 5 before repeating the next coating steps.

In order to realize supersensitivity in a separated-function type laminated receptor, not only is it necessary to use a charge generating material having high quantum efficiency, but it is also necessary to form a very thin charge generating layer in order to increase the ratio of charge generating material within the charge generating layer or to move the electrons toward the substrate faster, the speed of the electrons being very slow compared to the speed in which the holes move toward the charge transferring layer.

However, during the application of the electric charge generating layer, external defects can be generated such as the unevenness of the film thickness, the ring-like stripes, the fluid droppings, and the belt-like liquid pool formed on the lower end of the base. Further, since the coating fluid for the charge generating layer is a pigment dispersion fluid, if the dispersion is of poor quality, the pigments can aggregate and create black dots or white dots.

These defects are caused by the fouling of the base body, the uneven dispersion of the application fluid, or the convection within the coated layer when the coated solvent is evaporating. Therefore, the charge generating material can be in some locations while not being in other areas of the layer. Such unevenness of the coated layer causes fatal image defects especially in the charge generating layer of the supersensitive receptor required to be thin, and deteriorates the quality of the image forming device.

Japanese Patent Laid-Open Publication No. 2-203348, Japanese Patent Laid-Open Publication No. 4-14053, and Registered patent Publication No. 2853336 disclose methods for improving the coating fluid for the charge generating layer in order to overcome the above-mentioned problems. These references disclose a method for using and mixing two kinds of organic solvents as the coating fluid (each using dioxane/cyclohexanone, low boiler/high boiler solvents, or low viscosity/high viscosity solvents), and the references all insist that these. solvents improve the dispersibility, the stability and the application performance of the coating fluid.

However, in the case of the coating fluid formed of more than two kinds of mixed solvents, the difference in the boiling point, the vapor pressure, the vapor rate and the like of the different solvents causes the quantity of evaporation of each solvent to differ, causing the composition ratio including the mixed solvent ratio within the coating fluid to vary. If the composition ratio of the mixed solvents is varied, the quality of the coated layer can be deteriorated by the change in color or forming of dews on the layer, or the dispersibility or solubility of the solution can be deteriorated.

Moreover, though the prior art references insist that the coating unevenness is solved by their inventions, since they mix different solvents that have different properties, the applicability is deteriorated and coating unevenness is still caused by the change or bias in surface tension when the solvents in the applied layer evaporate.

Therefore, other references (refer to Japanese Patent Laid-Open Publication Nos. 6-208230 and 7-295247) disclose method of including polydimethylsiloxane in the coating fluid for forming the charge generating layer.

SUMMARY OF THE INVENTION

The technique disclosed in the cited references aim at improving the dispersibility, the stability and the application performance of the coating fluid by including a polydimethylsiloxane in the coating fluid of the charge generating layer in a laminate type receptor comprising at least an electric charge generating layer and an electric charge transferring layer.

However, according to the recent trend of cutting down the manufacture cost, an undercoating layer is often formed since a base tube having a rough surface roughness is used in creating the receptor. In a receptor comprising an undercoating layer that is required to have supersensitivity, the charge generating layer must be formed very thin, so the techniques disclosed in the references are not enough to solve the problem of the charge generating layer with defects caused by the uneven coating of the undercoating layer surface.

The present invention aims at solving the above-mentioned problems of the prior art. The object of the present invention is to provide a coating fluid having good dispersibility, improved stability and good application property for forming the electric charge generating layer that improves the supersensitivity of the laminate type separated-function receptor, and thereby enables to provide a stable and improved organic electrophotographic receptor at a low cost.

The present invention relates to a coating fluid for forming an electric charge generating layer of an organic electrophotographic receptor comprising at least an undercoating layer, an electric charge generating layer, and an electric charge transferring layer which are laminated sequentially, said coating fluid being composed of at least an electric charge generating material, a binding resin, a silicon oil having a surface tension of 22 mN/m or less, and an organic solvent.

According to the present invention where silicon oil is included in the coating fluid for forming the electric charge generating layer, the surface tension of the coating material is reduced, and therefore the wetting characteristic of the fluid is improved by the improved dispersibility of the pigments and the reduced interfacial energy difference with the undercoating layer surface. Therefore, according to the invention, the dispersibility, the stability and the coating ability of the coating fluid is improved. The present invention prevents the occurrence of deteriorated exteriority such as layer unevenness, ring-like stripes, fluid dripping, belt-like fluid pool formed at the lower end of the base, or black/white dots formed by the pigments being gathered due to bad dispersion.

Moreover, the present invention characterizes especially in using a silicon oil having a surface tension of 22 mN/m or less in the coating fluid for electric charge generating layer of an organic electrophotographic receptor comprising at least an undercoating layer, an electric charge generating layer, and an electric charge transferring layer which are laminated in this order. Therefore, in a receptor comprising an undercoating layer utilizing a base tube having a rough surface so as to cut down the cost etc., if there is a need for supersensitivity and the electric charge generating layer must be formed very thin, the coating material will not be influenced by the interfacial energy of the undercoating layer surface, and coating unevenness is prevented. In contrast, if the surface tension of the silicon oil is greater than the maximum value set according to the present invention, the interfacial energy difference becomes great and the leveling effect decreases, thereby causing coating unevenness.

According further to the present invention, the viscosity of the silicon oil is 50 cs or less.

According to this feature of the invention, when the coating fluid for electric charge generating layer aims at providing supersensitivity, the viscosity of the coating fluid must be set low, generally in the range of 1 to 30 cs, so as to form a thin layer. Therefore, the present invention limits the viscosity of the silicon oil to 50 cs or less, setting a sufficiently small viscosity difference with the coating fluid, which brings out the leveling effect of the silicon oil sufficiently. Further, this effect is maintained for a long time, preventing the occurrence of deteriorated exteriority such as layer unevenness, ring-like stripes, fluid dripping, belt-like fluid pool formed at the lower end of the base, or black/white dots formed by the pigments being gathered due to bad dispersion. In contrast, when the viscosity exceeds the range set according to the present invention, the aimed effect is obtained at first, but as time passes the coating fluid and the silicon oil are separated, and the same effects can no longer be provided in long term.

Moreover, the coating fluid for forming an electric charge generating layer of an organic electrophotographic receptor according to the invention is characterized in that the amount of the silicon oil being added is in the range of 1–30 weight % against said binding resin.

By setting the added amount of silicon oil to be in the range of 1 to 30 weight % against the binding resin, the present invention enables. to constantly prevent the occurrence of deteriorated exteriority such as layer unevenness, ring-like stripes, fluid dripping, belt-like fluid pool formed at the lower end of the base, or black/white dots formed by the pigments being gathered due to bad dispersion, without deteriorating the electric characteristics of the photoreceptor. If the amount is less than the range set according to the invention, the aimed leveling effect is not sufficiently exerted, and when the amount is greater than the set range, the rise potential increases during repeated use, making it difficult to maintain an appropriate image density.

Even further, the coating fluid for forming an electric charge generating layer of an organic electrophotographic receptor characterizes in that the silicon oil is polydimethylsiloxane.

According to the invention where the silicon oil is polydimethylsiloxane, the dispersibility, the stability and the coating ability of the coating fluid is improved. Therefore, the present invention enables to prevent the occurrence of deteriorated exteriority such as layer unevenness, ring-like stripes, fluid dripping, belt-like fluid pool formed at the lower end of the base, or black/white dots formed by the pigments being gathered due to bad dispersion.

Further, the present invention characterizes in that the silicon oil is polymethylphenylsiloxane.

According to the invention where the silicon oil is polymethylphenylsiloxane, the dispersibility, the stability and the coating ability of the coating fluid is improved. Therefore, the present invention enables to prevent the occurrence of deteriorated exteriority such as layer unevenness, ring-like stripes, fluid dripping, belt-like fluid pool formed at the lower end of the base, or black/white dots formed by the pigments being gathered due to bad dispersion.

Even further, the present invention characterizes in that the electric charge generating material is an oxotitanyl phthalocyanine crystal that shows a maximum diffraction peak at a Bragg angle (2θ±0.2°) of 9.4° or 9.7° and further show clear diffraction peaks at least at 7.3°, 9.4°, 9.7° and 27.30° according to an X-ray diffraction spectrum.

According to the invention, the coating fluid for the charge generating layer comprising an oxotitanyl phthalocyanine crystal that shows a maximum diffraction peak at a Bragg angle (2θ±0.2°) of 9.4° or 9.7°, and further show clear diffraction peaks at least at 7.3°, 9.4°, 9.7° and 27.3° according to an X-ray diffraction spectrum provides the best coating performance. Moreover, the material fluid enables to create a constantly stable and uniform coating layer for a long time.

Further, the present invention characterizes in that the binding resin is a butyral resin.

According to the invention where the coating fluid for the charge generating layer comprises a butyral resin as the binding resin, the coating fluid provides great electric characteristics. Moreover, the fluid enables to create a constantly stable and uniform coating layer for a long time.

Even further, the present invention characterizes in that the organic solvent is a non-halogen series organic solvent, and is further a mixture of two or more kinds of non-halogen series organic solvents.

According to the present invention utilizing a non-halogen series organic solvent, a safe method for manufacturing receptors is provided having no bad effect on the environment or on the operators. Further, when more than two kinds of mixed solvents are used to bring out the performance of the charge generating material sufficiently, the density unevenness that may be cause during the drying process due to the difference in the evaporation speed/boiling point/vapor pressure/surface tension/relative density etc. of the different solvents is prevented according to the invention.

Further, the present invention characterizes in that the organic solvent is a mixture of dimethoxyethane/cyclohexanone.

According to the present invention related to a coating fluid for forming a charge generating layer especially comprising an oxotitanyl phthalocyanine crystal that shows a maximum diffraction peak at a Bragg angle (2θ±0.2°) of 9.40° or 9.7°, and further show clear diffraction peaks at least at 7.3°, 9.4°, 9.7° and 27.3° according to an X-ray diffraction spectrum, and with a mixed solvent composition providing the best performances, it is possible to provide a constantly stable and uniform coating layer during the whole lifetime of the coat material.

Even further, the present invention provides an organic electrophotographic receptor having an electric charge generating layer formed on a cylindrical conductive base, wherein said electric charge generating layer is formed by dip coating a coating fluid composed at least of an electric charge generating material, a binding resin, a silicon oil having a surface tension of 22 mN/m or less, and an organic solvent, and further provides a method for manufacturing an electric charge generating layer on a cylindrical conductive base by dip coating the coating fluid according to the present invention.

According to the present invention where silicon oil is included in the coating fluid for forming the charge generating layer, the dispersibility, the stability and the coating ability of the coating fluid is improved. Therefore, the invention enables to provide an organic electrophotographic receptor while preventing the occurrence of deteriorated exteriority such as layer unevenness, ring-like stripes, fluid dripping, belt-like fluid pool formed at the lower end of the base, or black/white dots formed by the pigments being gathered due to bad dispersion.

According to yet another aspect, the present invention provides a coating fluid for forming an electric charge generating layer of an organic electrophotographic receptor comprising at least an undercoating layer, an electric charge generating layer, and an electric charge transferring layer which are laminated in said order, wherein the coating fluid includes a silicon oil having a surface tension of 22 mN/m or less. Therefore, in a receptor comprising an undercoating layer utilizing a base tube having a rough surface so as to cut down the cost etc., if there is a need for supersensitivity and the electric charge generating layer must be formed very thin, the present invention provides a coating fluid that effectively prevents coating unevenness, and enables to provide an organic electrophotographic receptor suited for supersensitivity that is constantly even and can be manufactured at low cost.

DETAILED DESCRIPTION OF PREFERRED EMBODIMENTS

Figure 1:
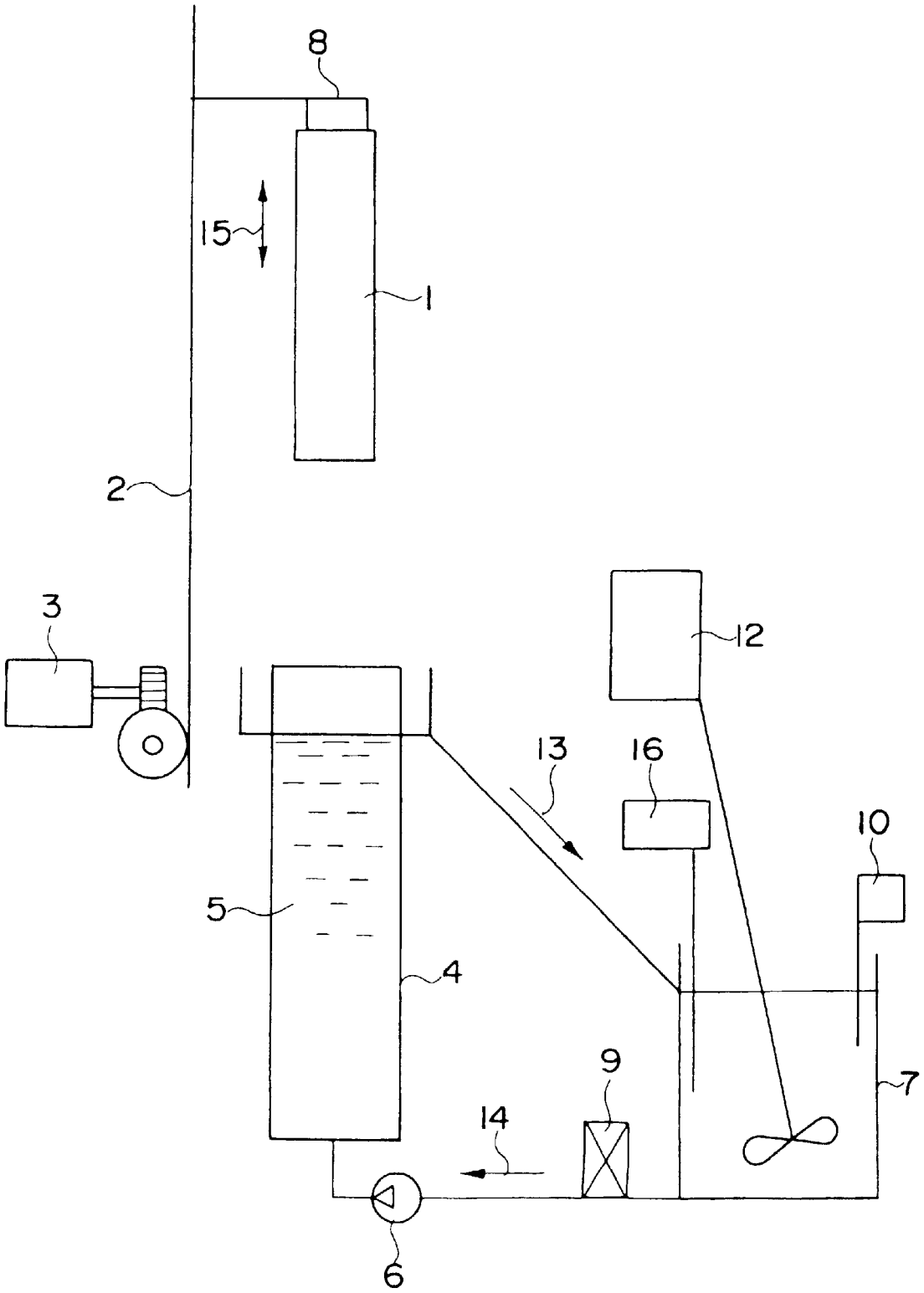
FIG. 1 is an explanatory view showing the outline of one example of the coating device for dip coating and forming a photosensitive layer on a conductive base.

The preferred embodiment of the present invention will now be explained with reference to the drawings.

First, the material for the organic electrophotographic receptor utilized in general will be explained. However, the receptor material according to the present invention is not limited to the contents disclosed in this specification.

The base can be formed using metal having conductivity such as aluminum, copper, brass, zinc, nickel, stainless steel, chromium, molybdenum, vanadium, indium, titanium, gold, platinum and the like, or alloys made thereof. Other than these materials, the following can also be used as the material; a polyester film, a paper or a metal film coated or evaporated with aluminum, aluminum alloy, tin oxide, gold, or indium oxide, plastic or paper including conductive particles, and plastic including conductive polymer. These materials are processed into shapes such as cylindrical shape, pipe-like shape or thin-film shape before use. Since the conductive base utilized in the present invention is coated by a dip coating method, the shape of the material is preferably cylindrical.

Next, the structure of the laminate type receptor is explained.

Upon forming the photosensitive layer, an undercoating layer is often formed between the conductive base and the electric charge generating layer/electric charge transferring layer so as to cover the defects and unevenness of the conductive base, to prevent deterioration of electrification upon repeated usage, and to improve the electrification performance under low temperature/low humidity environment. According to the present invention, an undercoating layer is formed.

Known materials for the undercoating layer include polyamide, copolymer nylon, polyvinyl alcohol, polyurethane, polyester, epoxy, phenolic plastic, casein, cellulose, and gelatin. Especially, copolymer nylon having alcohol solubility is often used.

These material are dispersed in water and various organic solvents such as a single solvent of water, methanol, ethanol or butanol, a mixed solvent including water/alcohol or more than two kinds of alcohol, a mixed solvent comprising acetone, dioxolane etc./alcohol, or a mixed solvent comprising chloric solvent such as dichloroethane, chloroform, trichloroethane etc./alcohol. The solvent is coated on the surface of the conductive base using for example the dip coating device shown in the drawing.

Further according to need, inorganic pigments such as zinc oxide, titanium oxide, tin oxide, indium oxide, silica, antimony oxide and the like can be dispersed using a disperser such as a ball mill, a dyno mill or an ultrasonic oscillator, so as to adjust the volume resistivity of the undercoating layer or to improve the repeated aging property under low temperature/low humidity environment.

The ratio of inorganic pigment within the undercoating layer should preferably be in the range of 30 to 95 weight %, and the thickness of the coated film should be in the range of 0.1 to 5 $\mu$m.

The electric charge generating layer is mainly composed of a charge generating material that generates charge by light radiation, and includes a known binding resin, plasticizer, or sensitizer according to need.

The charge generating material can include perylene series pigments such as perylene imide or perylic anhydride, polycyclic chinone series pigments such as quinacridon or anthraquinone, phthalocyanine series pigment such as metallic and nonmetallic phthalocyanine or nonmetallic phthalocyanine halide, squarium pigments, azulenium pigments, thiaperyllium pigments, or azo pigments having carbazole skeleton, styrylstilbene skeleton, triphenylamine skeleton, dibenzothiophene skeleton, oxodiazole skeleton, fluorenone skeleton, bisstilbene skeleton, distyryloxadiazole skeleton, or distyrylcarbazole skeleton.

The examples of pigments providing especially high charge generating performance include nonmetallic phthalocyanine pigments, oxotitanyl phthalocyanine pigments, gallium (chlor-) phthalocyanine pigments or mixed crystal of metallic phthalocyanine and nonmetallic phthalocyanine, bisazo pigments including fluorene ring and fluorenone ring, bisazo pigments comprising aromatic amine, and trisazo pigments. These materials enable to provide a receptor having high sensitivity.

The examples of the binding resin include melamine resin, epoxy resin, silicon resin, polyurethane resin, acrylic resin, polyvinyl chloride acetate copolymer resin, polyvinyl chloride acetate-maleic anhydride copolymer resin, polyvinyl chloride acetate-polyvinyl alcohol copolymer resin, polycarbonate resin, phenoxy resin, phenolic resin, polyvinyl butyral resin, polyallylate resin, polyamide resin, and polyester resin. The examples of the solvent for dissolving the resin include ketones such as acetone, methyl ethyl ketone and cyclohexanone, esters such as ethyl acetate and butyl acetate, ethers such as tetrahydrofuran, dioxane, dioxolane and dimethoxyethane, arenes such as benzene, toluene and xylene, and aprotic polar solvents such as N,N-dimethylformamide and dimethyl sulfoxide.

The methods for manufacturing the charge generating layer include a method of forming the layer directly with the compound by vacuum deposition and a method of forming the layer by dispersing the material in a binding resin solution and coating the same onto the base. The latter method is generally more preferable, and the method of mixing and dispersing the charge generating material in the binding resin solution and the coating method thereof is the same as those explained in the process of applying the undercoating layer. The ratio of electric charge generating material in the charge generating layer is preferably in the range of 30 to 90 weight %. The thickness of the charge generating layer is 0.05 to 5 $\mu$m, and more preferably in the range of 0.1 to 2.5 $\mu$m.

The coating fluid especially used for forming the charge generating layer in the present invention should preferably be formed of a mixed solvent including oxotitanyl phthalocyanine crystal, butyral resin, silicon oil and dimethoxyethane/ cyclohexanone, the crystal showing the maximum diffraction peak ataBragg angle ($2\theta \pm 0.2°$) of 9.4° or 9.7°, and clear diffraction peaks at least at 7.3°, 9.4°, 9.7° and 27.3° according to an X-ray diffraction spectrum. Further, the thickness of the layer should preferably be between 0.1 through 1.5 $\mu$m.

The charge transferring layer formed above the charge generating layer includes charge transferring material having the function to receive the electric charge generated from the charge generating material and to transfer the same, a binding resin, and if necessary a known plasticizer, a sensitizer and the like. Examples of the charge transferring material include poly-N-vinyl carbazole and its derivative, poly-γ-carbazolylethyl glutamate and its derivative, pyrene-formaldehyde condensate and its derivative, polyvinyl pyrene, polyvinyl phenanthrene, oxazole derivative, oxadiazole derivative, imidazole derivative, 9-(p-diethylaminostyryl)anthracene, 1,1-bis (4-dibenzyl aminophenyl)propane, styryl anthracene, styryl pyrazoline, pyrazoline derivative, phenylhydrazones, hydrazone derivative, triphenylamine series compounds, triphenylmethane series compounds, stilbene series compounds, or azine compounds having a 3-methyl-2-benzothiazoline ring, the above being electron-repelling materials, or fluorenone derivative, dibenzothiophene derivative, indenothiophene derivative, phenanthrenequinone derivative, indenopyridine derivative, thioxanthone derivative, benzo [C] cinnoline derivative, phenazine oxide derivative, tetracyanoethylene, tetracyanoquinodimethane, bromanil, chloranil, and benzoquinone, the above being electron-accepting materials.

The binding resin constituting the charge transferring layer should have compatibility with the charge transferring material, and examples of the resin include polycarbonate and polycarbonate copolymer, polyarylate, polyvinyl butyral, polyamide, polyester, epoxy resin, polyurethane, polyketone, polyvinyl ketone, polystyrene, polyacrylamide, phenolic plastic, phenoxy resin, polysulfone resin, and the copolymer resin of the above mentioned materials. These materials can either be used alone or by a mixture of two or more materials. Especially the following resins, polystyrene, polycarbonate and polycarbonate copolymer, polyarylate, and polyester, have volume resistivity of $10^{13}$ Ω or more, and they have advantageous layer forming performance and potential characteristics. Examples of the solvent for dissolving these materials include alcohols such as methanol and ethanol, ketones such as acetone, methyl ethyl ketone and cyclohexanone, ethers such as ethyl ether, tetrahydrofuran, dioxane or dioxolane, aliphatics such as chloroform, dichloromethane or dichloroethane, or aromatics such as halogen hydrocarbon, benzene, chlorobenzene or toluene.

The coating fluid for forming the charge transferring layer is created by dissolving the charge transferring material into a binding resin solution, and the ratio of the transferring material should preferably be in the range of 30 to 80 weight %. The thickness of the charge transferring layer should be in the range of 10–50 μm, and preferably between 15–40 μm.

After coating and forming these photosensitive layers in order, or every time one layer of photosensitive coating is applied, the material is dried with a drier using either heated wind or far infrared light, thereby completing the formation of photosensitive layers. The drying should preferably be performed for 10 minutes–2 hours under the temperature of 40–130° C.

The solvent used in the coating fluid for forming each photosensitive layer mentioned above is not limited to those disclosed above, but in the present invention, a non-chlorine (halogen) series organic solvent is preferably used considering the environment and the safety of the workers.

Further, in order to improve the sensitivity and to suppress the increase of rise potential or fatigue during repeated usage, the photosensitive layer of the electrophotographic receptor can include one kind or more than two kinds of electron-accepting material or pigments. As for the electron-accepting material, the following material can be used as chemical sensitizer; acid anhydrides such as succinic anhydride, maleic anhydride, phthalic anhydride, and 4-chlornaphthalic anhydride, cyano compounds such as tetracyanoethylene and terephthalic malonic dinitrile, aldehydes such as 4-nitrobenzaldehyde, anthraquinones such as anthraquinone and 1-nitroanthraquinone, or polycyclic or heterocyclic nitro compounds such as 2,4,7-trinitrofluorenone and 2,4,5,7-tetranitrofluorenone.

As for the pigments, organic photoconductive compounds such as xanthene series pigments, thiazine pigments, triphenylmethane pigments, quinoline series pigments and copper phthalocyanine pigments can be utilized as the optical sensitizer.

Moreover, the photosensitive layer can include a known plasticizer in order to improve the formability, the flexibility and the mechanical strength. The examples of the plasticizer include diacid ester, fatty ester, phosphoric ester, phthalate ester, chlorinated paraffin and epoxy plasticizer. According to need, the layer can also include a leveling agent such as polysiloxane for preventing orange peel, material for improving the durability such as phenol system compound, hydrokinone system compound and tocopherol system compound, an antioxidant, an UV absorbent and the like such as amino system compounds.

According to any method of forming the receptor and forming the layered structure, the electrophotographic receptor according to the present invention is manufactured by a manufacturing device represented by the dip coating device shown in FIG. 1. Especially in the coating fluid for forming the charge generating layer, which is a coating fluid with dispersed pigments, a coating fluid dispersion device (for example an ultrasonic generator) can be equipped to the present device so as to stabilize the dispersion of the coating fluid.

Next, an example of the image forming device is explained with reference to the explanatory view showing the outline thereof. However, the image forming device according to the present invention is not limited to the example disclosed below.

Figure 2:
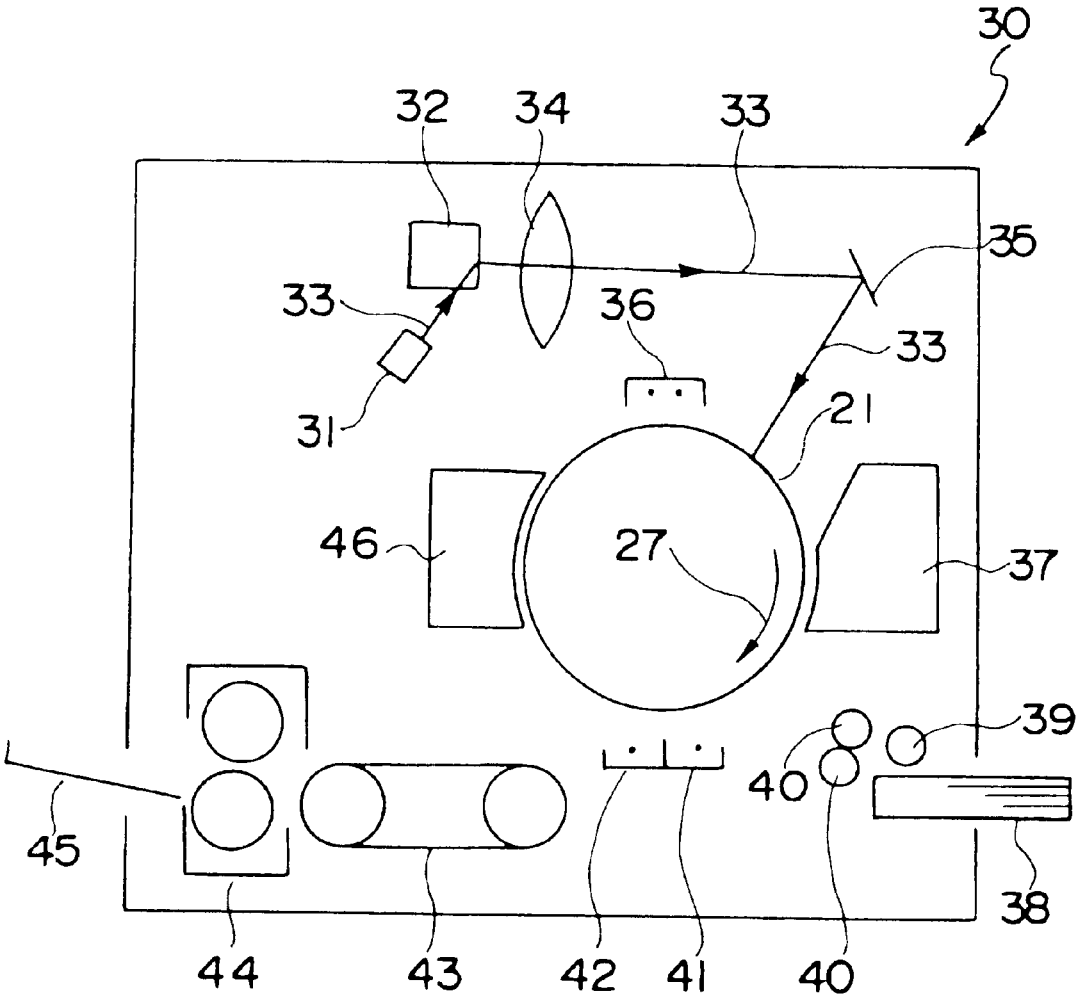
FIG. 2 is an explanatory view showing one example of the image forming device according to the present invention.

FIG. 2 is an explanatory view showing the structure of a laser printer equipped with the organic electrophotographic receptor manufactured according to the method of the present invention.

A laser printer 30 comprises a receptor 21, a semiconductor laser 31, a rotating polygon mirror 32, an imaging lens 34, a mirror 35, a corona electrifier 36, a developer 37, a trans fer paper cassette 38, a paper feeding roller 39, a resist roller 40, a transfer electrifier 41, a separating electrifier 42, a carrier belt 43, a fixer 44, an eject tray 45 and a cleaner 46.

The receptor 21 is mounted on the laser printer 30 so that it is capable of rotating in the direction of arrow 27 in the drawing by a driving means not shown. The laser beam 33 from the semiconductor laser 31 repeatedly scans the surface of the receptor 21 by the rotating polygon mirror 32 in the longitudinal direction thereof (main scanning direction). The image forming lens 34 has f-θ characteristic, and the image is formed on the surface of the receptor 21 by reflecting the laser beam 33 by the mirror 35, and exposing the same. By rotating the receptor 21 and by scanning the same using the laser beam 33 as mentioned above to form the image, an electrostatic latent image is formed on the surface of the receptor 21.

The corona electrifier 36 is mounted on the upstream side of rotation of the receptor 21 than the image forming point of the laser beam 33 so as to evenly electrify the surface of the receptor 21. The developer 37 is mounted on the downstream side of rotation than the image forming point so as to provide toner to the receptor 21 and to develop the electrostatic latent image as a toner image. The transfer sheet stored within the transfer sheet cassette 38 is taken out one by one with a paper feed roller 39. It is sent out by the resist roller 40 toward the transfer electrifier 41 mounted downstream from the eveloper 37 in synchronism with the exposure of receptor 21, and the toner image is transferred onto the transfer sheet. A separating electrifier 42 is mounted further downstream from and adjacent to the transfer electrifier 41, and the separating electrifier 42 diselectrifies the transfer sheet onto which the toner image is transferred, and separates the same from the receptor 21.

The separated transfer sheet is transferred to the fixer 44 by the carrier belt, and there the toner image is fixed onto the transfer sheet. The transfer sheet onto which the image is formed is positioned on the eject tray 45. Further, a cleaner 46 for cleaning the toner residing on the surface of the receptor 21 is positioned, together with a diselectrifying lamp not shown, on the downstream side of the separating electrifier 42 and upstream of the corona electrifier 36.

By rotating the receptor 21 as explained above, the image forming process is repeated.

Moreover, the structure of the laser printer 30 is not limited to that shown in FIG. 2, but any structure can be used as long as the receptor according to the present invention is applicable. For example, if the outer diameter of the receptor 21 is 40 mm or less, there is no need to mount the separating electrifier 42.

Moreover, the receptor 21 can be formed integrally with at least one of the following to form a process cartridge; the corona electrifier 36, the developer 37 or the cleaner 46. The examples of the process cartridge include a process cartridge including the receptor 21, the corona electrifier 36, the developer 37 and the cleaner 46, a process cartridge including the receptor 21, the corona electrifier 36 and the developer 37, a process cartridge including the receptor 21 and the cleaner 46, and a process cartridge including the receptor 21 and the developer 37. The advantage of using the process cartridge is that the replacement of the member mounted in a printer and the like is simplified.

Other than the corona electrifier, a colotron electrifier, a scorotron electrifier, a sawtooth electrifier or a roller electrifier can be used as the electrifier 36. As for the developer 37, at least either a contact type developer or a non-contact type developer can be used. As for the cleaner 46, a blade cleaner or a brush cleaner and the like can be used.

The diselectrifying lamp (not shown) can be omitted by working on the timing for providing high voltage such as the developing bias for example. Especially, the diselectrifying lamp is often eliminated in a low-speed low-end printer or those having a small drum diameter.

EXAMPLES OF THE INVENTION

The following is an explanation of the coating fluid according to the invention based on the actual examples. However, the coating fluid according to the present invention is not limited to the following description.

Example 1

A coating fluid for forming the undercoating layer is created by forming a mixed solvent comprising 56.4 weight % of methanol and 37.6 weight % of 1.3-dioxolane (mixture ratio =60/40), and adding thereto 2.1 weight % of rutile-type titanium oxide (manufactured by Ishihara Sangyo: TTO-M-1), and further adding 3.9 weight % of copolymer nylon resin (manufactured by Toray Industries: CM4000) as the binder resin, and dispersing the mixture for 8 hours using a paint shaker.

This coating fluid is coated using the dip coating device shown in FIG. 1 so that the dried layer has a thickness of 1.0 $\mu$m, according to which an undercoating layer having an even thickness is obtained.

Next, a coating fluid for forming the electric charge generating layer is formed. A mixture is formed comprising 1.8 weight % of oxotitanyl phthalocyanine crystal having the maximum diffraction peak at a Bragg angle (2θ±0.2°) of either 9.4° or 9.7° and further having clear diffraction peaks at least at 7.3°, 9.4°, 9.7° and 27.3° based on an X-ray diffraction spectrum, 1.2 weight % of butyral resin (manufactured by Sekisui Chemical: Eslek BM-2), 0.06 weight % of polydimethylsiloxane-silicon oil (manufactured by Shin-Etsu Chemical: KR-96), 77.6 weight % of dimethoxyethane and 19.4 weight % of cyclohexanone (mixture ratio=80/20), the mixture then being dispersed for 12 hours in a ball mill.

Coating is performed on the middle layer formed as above using a similar dip coating device so that the dried layer has a thickness of 0.6 $\mu$m. Thereby, an even electric charge generating layer is created as shown in Table 1 with no coating unevenness.

Next, a mixture comprising 8.4 weight % of butadiene series charge transferring material having a structural formula (III) (manufactured by Takasago Corporation: 1,1-bis (p-diethylaminophenyl)-4, 4-1,3-butadiene), 12.6 weight % of polycarbonate resin (manufactured by Idemitsu Kosan: Toughzet B-300), and 0.03 weight % of silicon series leveling material (manufactured by Shin-Etsu Chemical: KF-96) is added to 79 weight % of tetrohydrafuran, and the mixture is heated at 45° C. so as to dissolve the material completely. The fluid is then cooled naturally and adjusted to create the coating fluid for forming the electric charge transferring layer. This coating fluid is coated using the coating device of FIG. 1 so that the thickness of the formed layer is 17 $\mu$m, which is dried at a temperature of 80° C. for an hour, thereby completing the LPB electrophotographic receptor.

The formed receptor is mounted on an image forming device, and it is confirmed that the receptor has advantageous image characteristics.

The same procedure was performed three months after forming the coating fluid to create a receptor, and an even coating layer was obtained similar to the one initially obtained.

Example 2

Further, a similarly good result was obtained when using a silicon oil (manufactured by Toshiba Silicones: TSF451) instead of KF-96.

Examples 3–4, Comparison Examples 1–2

Receptors were created according to the same procedures and using the same materials as example 1, except that in the coating fluid for forming the charge generating layer, the silicon oil was replaced with 0.06 weight % of polymethylphenylsiloxane-silicon oil KF-50, KF-54, KF56 or KF69, respectively (manufactured by Shin-Etsu Chemical).

As shown in Table 1, in the cases where KF-50 (example 3) and KF-69 (example 4) are used, a coating layer with advantageous characteristics similar to that of example 1 was obtained with no coating unevenness. However, in the cases where KF-56 (comparison example 1) and KF-54 (comparison example 2) were used in the charge generating coating fluid, coating unevenness was found above and under the drum, and the unevenness of the layer was particularly bad especially close to the end of the drum.

Example 5, Comparison Example 3

Receptors were created according to the same procedures and using the same materials as example 1, except that the silicon oil was respectively replaced with 0.06 weight % of polymethylphenylsiloxane-silicon oil KF-96–50cs, or KF-96–100 cs (manufactured by Shin-Etsu Chemical).

As shown in Table 1, in the case of example 5 utilizing KF-96–50cs, similar to example 1, a good coating layer was obtained with no coating unevenness for a long time. However, in the coating fluid utilizing KF-96–100cs (comparison example 3), a uniform coating layer was obtained initially but after three weeks from creating the fluid, uneven film thickness above and under the drum and local blockiness were observed, deteriorating the image quality of the receptor.

(Examples 6–7, Comparison Examples 4–5)

Receptors were created according to the same procedures and using the same materials as example 1, except that in the coating fluid for forming the charge generating layer of example 1, the amount of silicon oil being added is varied from none, 0.18 weight %, 0.36 weight %, and 0.6 weight %.

As shown in Table 1, examples 6 and 7 are created having 0.18 and 0.36 weight % of silicon being added, and both coating fluids realized good coating layers with no coating unevenness for a long time, similar to example 1. However, according to comparison example 4 where no silicon oil was added, uneven layer thickness above and under the drum and local blockiness were observed. According to comparison example 5 where 0.6 weight % of silicon oil was added to the coating fluid, no coating unevenness was observed, but the rising of the rest potential was especially bad, and the created receptor could not provide appropriate image concentration.

Comparison Examples 6–7

Receptors were created according to the same procedures and using the same materials as example 1, except that in the coating fluid for forming the charge generating layer of example 1, the solvent was dispersed using 97 weight % amount of dimethoxyethane, or using 97 weight % amount of cyclohexanone.

The receptor created using only dimethoxyethane showed good coating performance but compared to example 1, the sensitivity of the receptor was deteriorated. The crystal formation of the created coating fluid was observed, and according to the X-ray diffraction spectrum, the formation was not the oxotitanyl phthalocyanine crystal that shows a maximum diffraction peakat Bragg angle (2θ±0.2°) 9.4° or 9.7°, and shows clear diffraction peaks at least at 7.3°, 9.4°, 9.7° and 27.3°.

Further, according to the receptor created using only the cyclohexanone, the evaporation of the solvent took a very long time, so even though silicon oil was added, concentration (layer thickness) unevenness was observed above and under the drum.

Comparison Example 8

A receptor was created according to the same procedures and using the same materials as example 1, except that in the coating fluid for forming the charge generating layer of example 1, the resin was replaced with polyester resin (manufactured by Toyobo: Byron 200).

Even though oxotitanyl phthalocyanine crystal was created in the receptor being formed, where according to an X-ray diffraction spectrum, the crystal shows a maximum diffraction peak at Bragg angle (2θ±0.2°) 9.4° or 9.7°, and shows clear diffraction peaks at least at 7.3°, 9.4°, 9.7° and 27.3°, the receptoror according to the present comparison example has deteriorated sensitivity compared to the receptor of example 1, and the electrification after repeated usage is also deteriorated, so it was impossible according to the receptor of comparison example 8 to maintain a predetermined image concentration.

TABLE 1

| | Silicon oil | Grade | Viscosity: cs | Added amount: amount/ratio | Coat unevenness (initial) | Coat unevenness (long term) | Surface tension mN/m |
|---|---|---|---|---|---|---|---|
| Example 1 | KF-96 | dimethyl | 10 | 0.06/5 | ○ | ○ | 20.1 |
| Example 2 | TSF-451 | dimethyl | 30 | 0.06/5 | ○ | ○ | 20.5 |
| Example 3 | KF-50 | methyl phenyl | 100 | 0.06/5 | ○ | x | 21.8 |
| Example 4 | KF-69 | dimethyl | 20 | 0.06/5 | ○ | ○ | 19.7 |
| Compar. 1 | KF-56 | methyl phenyl | 15 | 0.06/5 | x | x | 24.2 |
| Compar. 2 | KF-54 | methyl phenyl | 400 | 0.06/5 | x | x | 25.2 |
| Example 5 | KF-96 | dimethyl | 50 | 0.06/5 | ○ | ○ | 20.8 |
| Compar. 3 | KF-96 | dimethyl | 100 | 0.06/5 | ○ | x | 20.9 |
| Compar. 4 | NONE | — | — | 0.06/5 | x | x | — |
| Example 6 | KF-96 | dimethyl | 10 | 0.18/15 | ○ | ○ | 20.1 |
| Example 7 | KF-96 | dimethyl | 10 | 0.36/30 | ○ | ○ | 20.1 |
| Compar. 5 | KF-96 | dimethyl | 10 | 0.6/50 | ○ | ○: electrification x | 20.1 |

We claim:

1. A coating fluid for forming an electric charge generating layer of an organic electrophotographic receptor comprising at least an undercoating layer, an electric charge generating layer, and an electric charge transferring layer which are laminated in said order, said coating fluid comprising an electric charge generating material, a binding resin, a silicon oil having a surface tension of 22 mN/m or less, and an organic solvent.

2. A coating fluid for forming an electric charge generating layer of an organic electrophotographic receptor according to claim 1, wherein the viscosity of said silicon oil is 50 cs or less.

3. A coating fluid for forming an electric charge generating layer of an organic electrophotographic receptor according to claim 1, wherein the amount of said silicon oil being added is in the range of 1–30 weight % against said binding resin.

4. A coating fluid for forming an electric charge generating layer of an organic electrophotographic receptor according to claim 1, wherein said silicon oil is polydimethylsiloxane.

5. A coating fluid for forming an electric charge generating layer of an organic electrophotographic receptor according to claim 1, wherein said silicon oil is polymethylphenylsiloxane.

6. A coating fluid for forming an electric charge generating layer of an organic electrophotographic receptor according to claim 1, wherein said electric charge generating material is an oxotitanyl phthalocyanine crystal that shows a maximum diffraction peak at a Bragg angle ($2\theta \pm 0.2°$) of 9.4° or 9.7°, and further show clear diffraction peaks at least at 7.3°, 9.4°, 9.7° and 27.3° according to an X-ray diffraction spectrum.

7. A coating fluid for forming an electric charge generating layer of an organic electrophotographic receptor according to claim 1, wherein said binding resin is a butyral resin.

8. A coating fluid for forming an electric charge generating layer of an organic electrophotographic receptor according to claim 1, wherein said organic solvent is a non-halogen series organic solvent, and is further a mixture of two or more kinds of non-halogen series organic solvents.

9. A coating fluid for forming an electric charge generating layer of an organic electrophotographic receptor according to claim 1, wherein said organic solvent is a mixture of dimethoxyethane/cyclohexanone.

10. An organic electrophotographic receptor having an electric charge generating layer formed on a cylindrical conductive base, wherein said electric charge generating layer is formed by dip coating a coating fluid composed at least of an electric charge generating material, a binding resin, a silicon oil having a surface tension of 22 mN/M or less, and an organic solvent.

11. A method for manufacturing an organic electrophotographic receptor, wherein an electric charge generating layer is formed on a cylindrical conductive base by dip coating a coating fluid composed at least of an electric charge generating material, a binding resin, a silicon oil having a surface tension of 22 mN/m or less, and an organic solvent.

12. A coating fluid for forming an electric charge generating layer of an organic electrophotographic receptor, the coating fluid comprising:

an electric charge generating material, a binding resin, a silicon inclusive oil having a surface tension of 22 mN/m or less, and an organic solvent.

13. The coating fluid of claim 12, wherein the silicon inclusive oil has a viscosity of 50 cs or less.

14. The coating fluid of claim 12, wherein the silicon inclusive oil has a viscosity of from 1–30 cs.

* * * * *